US010262775B2

(12) United States Patent
Doneker et al.

(10) Patent No.: US 10,262,775 B2
(45) Date of Patent: Apr. 16, 2019

(54) ENERGY EFFICIENT NOISE DAMPENING CABLES

(71) Applicant: Tangitek, LLC, Portland, OR (US)

(72) Inventors: Robert L. Doneker, Portland, OR (US); Kent G. R. Thompson, Portland, OR (US)

(73) Assignee: TANGITEK, LLC, Portland, OR (US)

( * ) Notice: Subject to any disclaimer, the term of this patent is extended or adjusted under 35 U.S.C. 154(b) by 0 days.

(21) Appl. No.: 14/137,521

(22) Filed: Dec. 20, 2013

(65) Prior Publication Data

US 2014/0102743 A1 Apr. 17, 2014

Related U.S. Application Data

(62) Division of application No. 13/180,412, filed on Jul. 11, 2011, now Pat. No. 8,658,897.

(51) Int. Cl.
*H01B 11/08* (2006.01)
*H01B 11/10* (2006.01)
(Continued)

(52) U.S. Cl.
CPC ..... *H01B 11/10* (2013.01); *H01B 1/04* (2013.01); *H01B 11/1066* (2013.01);
(Continued)

(58) Field of Classification Search
CPC ..... H01B 11/08; H01B 11/04
(Continued)

(56) References Cited

U.S. PATENT DOCUMENTS 3,193,712 A 7/1965 Harris
4,360,704 A 11/1982 Madry
(Continued)

FOREIGN PATENT DOCUMENTS

CN 201774688 U 3/2011
EP 0854536 A2 7/1998
(Continued)

OTHER PUBLICATIONS

Park, Ki-Yeon, et al., Application for MWNT-added Glass Fabric/Epoxy Composites to Electromagnetic Wave Shielding Enclosure, Department of Aerospace Engineering, Korea Advanced institute of Science and Technology, Composite Structures, v 81, n 3, 401-6, 2007; ISSN: 0263-8223; DOI: 10.1016/j.compstruct.2006.08.029; Publisher: Elsevier Science Ltd., UK.
(Continued)

*Primary Examiner* — Chau N Nguyen
(74) *Attorney, Agent, or Firm* — Miller Nash Graham & Dunn LLP

(57) ABSTRACT

Energy efficient noise dampening coaxial and twisted pair cables include certain layers to improve the quality of signals transmitted over the cables. A coaxial cable includes a conductive core, a first insulating layer surrounding the conductive core, a metal shield layer surrounding the first insulating layer, a second insulating layer surrounding the metal shield layer, a carbon material layer surrounding the second insulating layer, and a protective sheath wrapping the carbon material layer. A twisted pair cable section includes a core section. The core section includes a carbon material core, an insulating layer surrounding the carbon material core, and a metal shield layer surrounding the insulating layer. A plurality of twisted pair cables are disposed in sections or compartments defined by the core section, and between the core section and a protective sheath. Methods for constructing the cables are also disclosed.

5 Claims, 5 Drawing Sheets

(51) Int. Cl.
*H01B 1/04* (2006.01)
*H01B 11/18* (2006.01)

(52) U.S. Cl.
CPC ..... *H01B 11/1895* (2013.01); *H01B 11/1008* (2013.01); *H01B 11/1808* (2013.01); *H01B 11/1834* (2013.01)

(58) Field of Classification Search
USPC ..... 174/105 R, 102 SC, 113 R, 113 C
See application file for complete search history.

(56) References Cited

U.S. PATENT DOCUMENTS 4,388,623 A 6/1983 Crook et al.
4,684,020 A 8/1987 Ohlbach
4,703,134 A 10/1987 Uematsu
4,822,950 A 4/1989 Schmitt
4,986,372 A 1/1991 Ganssle
5,010,209 A 4/1991 Marciano-Agostinelli et al.
5,028,740 A 7/1991 Tomiya
5,043,538 A 8/1991 Hughey et al.
5,170,010 A 12/1992 Aldissi
5,171,938 A 12/1992 Katsumata et al.
5,236,736 A 8/1993 Kawakami et al.
5,300,733 A 4/1994 Uematsu
5,401,901 A 3/1995 Gerry et al.
5,486,648 A 1/1996 Chan et al.
5,493,070 A 2/1996 Habu
5,539,148 A 7/1996 Konishi et al.
5,952,615 A * 9/1999 Prudhon ..... H01B 11/02 174/113 C
6,104,357 A 8/2000 Brage
6,215,070 B1 4/2001 King
6,274,066 B1 8/2001 Easter
6,288,372 B1 9/2001 Sandberg et al.
6,384,337 B1 5/2002 Drum
6,503,364 B1 1/2003 Masuda et al.
6,514,608 B1 2/2003 Foulger
6,526,860 B2 3/2003 Facciano et al.
6,624,359 B2 * 9/2003 Bahlmann et al. ..... 174/113 C
6,697,248 B1 2/2004 Luch
6,786,771 B2 9/2004 Gailus
6,825,411 B2 11/2004 Pommerenke et al.
6,828,501 B2 12/2004 Eves et al.
6,897,826 B1 5/2005 Kunz
6,979,709 B2 12/2005 Smalley et al.
7,087,842 B2 8/2006 Belli et al.
7,202,418 B2 4/2007 Glew
7,276,664 B2 10/2007 Gagnon
7,345,242 B2 3/2008 Chen
7,449,631 B2 11/2008 Lee et al.
7,459,627 B2 12/2008 Lee et al.
7,491,883 B2 2/2009 Lee et al.
7,688,274 B2 3/2010 Gorrell et al.
7,738,942 B2 6/2010 Weiner et al.
7,750,240 B2 7/2010 Jiang et al.
7,939,167 B2 5/2011 Kim et al.
8,143,522 B2 * 3/2012 Laudenslager et al. .. 174/110 R
8,324,515 B2 12/2012 Stevenson et al.
8,583,259 B2 11/2013 Liu et al.
8,658,897 B2 * 2/2014 Doneker et al. ..... 174/105 R
2002/0189846 A1 12/2002 Massey
2004/0020681 A1 2/2004 Hjortstam et al.
2004/0154911 A1 8/2004 Burgess et al.
2005/0001780 A1 1/2005 Aisenbrey
2005/0011612 A1 1/2005 Yakushiji et al.
2005/0045358 A1 3/2005 Arnold
2005/0078050 A1 4/2005 Aisenbrey
2006/0083948 A1 4/2006 Toshiyuki et al.
2006/0237221 A1 10/2006 Glew
2007/0068787 A1 3/2007 Burgess et al.
2007/0089285 A1 4/2007 Utecht et al.
2007/0116916 A1 5/2007 Ito et al.
2007/0293086 A1 12/2007 Liang et al.
2008/0018549 A1 1/2008 Suzuki et al.
2008/0058467 A1 3/2008 Takagi et al.
2008/0129638 A1 6/2008 Ong
2009/0095523 A1 4/2009 Stevenson et al.
2009/0104405 A1 4/2009 Patten et al.
2009/0111325 A1 4/2009 Ju
2009/0114420 A1 5/2009 Winterhalter
2009/0120664 A1 5/2009 Clark et al.
2009/0120681 A1 5/2009 Matsuzaki
2009/0130995 A1 5/2009 Wang Chen
2009/0159328 A1 6/2009 Dai et al.
2009/0287426 A1 11/2009 Kukowski
2009/0291608 A1 11/2009 Choi et al.
2010/0000754 A1 1/2010 Mann et al.
2010/0038112 A1 * 2/2010 Grether ..... 174/128.1
2010/0052992 A1 3/2010 Okamura et al.
2010/0086729 A1 4/2010 Long
2010/0096160 A1 4/2010 Gareis et al.
2010/0159240 A1 6/2010 Shah et al.
2010/0178487 A1 7/2010 Arai et al.
2010/0188833 A1 7/2010 Liang et al.
2010/0236812 A1 9/2010 Laudenslager et al.
2010/0300744 A1 12/2010 Romanko et al.
2011/0005808 A1 1/2011 White et al.
2011/0062134 A1 3/2011 Lochtman et al.
2011/0209909 A1 9/2011 Doneker et al.
2011/0253441 A1 10/2011 Doneker et al.
2011/0253475 A1 10/2011 Doneker et al.
2011/0266023 A1 11/2011 Doneker et al.
2011/0309845 A1 12/2011 Kukowski

FOREIGN PATENT DOCUMENTS

EP 1191351 A2 3/2002
EP 1447819 A1 8/2004
EP 1612187 A1 1/2006
JP 54139358 10/1979
JP 55068703 5/1980
JP 57166702 10/1982
JP 58184805 10/1983
JP 59061203 4/1984
JP 60010806 1/1985
JP 06-021683 1/1994
JP 2004-095847 3/2004
JP 2005012841 A 1/2005
JP 2005-285923 10/2005
JP 2006-332260 12/2006
JP 2009174956 8/2009
JP 2010062571 3/2010
KR 10-2011-0016661 2/2011
TW 200929459 7/2009
TW 200929725 7/2009
WO 2005122331 A1 12/2005
WO 2008012300 A1 1/2008
WO 2010095925 A1 8/2010

OTHER PUBLICATIONS

Liu et al., "Measurement on Dipole Antenna with Light Polarized Nano-Material (PNM) Textile Reflector," IEEE MTT-S Intl. Microwave Symposium Digest, 2009. Jun. 7-12, 2009, pp. 1069-1072.
Koch, et al., Patrick, "0.6-M Antennae for the Ambia Interferometer Array," Proceedings of the European Conference on Antennas and Propagation: EuCAP 2006 (ESA SP-626), Nov. 6-10, 2006, Nice, France, Editors: H. Lacoste & I. Ouwehand, publilshed on CDROM, p. 668.1.
European Patent Office, Extended European Search Report, EP application No. 12751876.9, Munich, Germany, 11 pages, Jul. 21, 2014.

* cited by examiner

ENERGY EFFICIENT NOISE DAMPENING CABLES

CROSS REFERENCE TO RELATED APPLICATION

This application is a division of copending U.S. application Ser. No. 13/180,412, filed Jul. 11, 2011, incorporated by reference herein.

TECHNICAL FIELD

This disclosure relates to electrical cables, and, more particularly, to energy efficient noise dampening coaxial and twisted pair cables.

BACKGROUND

Electrical signals are often transmitted over cables such as coaxial or twisted pair cables. Such cables connect myriad devices located throughout the world one to another. For example, coaxial or twisted pair cables can connect computers to other computers, network switches to centralized servers, television stations to set top boxes in users' homes, mobile devices to computer docket devices, among many other configurations.

Coaxial cables conventionally include a core conducting wire surrounded by a dielectric insulator, a woven copper shield layer, and an outer plastic sheath. The concentric layers share the same geometric axis, and are relatively well suited for transmitting radio frequency signals due to their special dimensions and conductor spacing. To reduce the radiation from the transmitted signal, the copper shield layer is connected to ground, thus providing a constant electrical potential. Thus, radio waves are generally confined to the space between the conducting wire and the woven copper shield layer.

But traditional coaxial cable designs are subject to signal leakage, and in addition, losses or reductions in power. Signal leakage is caused by electromagnetic signals passing through the metal shield of the cable, and can occur in both directions. Metal shields are notoriously imperfect due to their holes, gaps, seams, and bumps. Making perfect metal shields is cost prohibitive and would make the cables bulky and exceptionally heavy.

Signals can be impacted by external electromagnetic radiation emitted from antennas, electrical devices, conductors, and so forth. Such interference can impact the quality and accuracy of signals that are transmitted over the cables. Errors introduced into the signals can range from generally mild effects such as video artifacts in a television signal, to more severe effects such as erroneous data transmitted to or from a critical device upon which human life depends.

Moreover, signal leakage can cause disruption to the signal being transmitted. In addition, noise can be leaked from the coaxial cable into the surrounding environment, potentially disrupting sensitive electronic equipment located nearby. Signal leakage also weakens the signal intended to be transmitted. In extreme cases, excessive noise can overwhelm the signal, making it useless.

Twisted pair cables conventionally include two wires that are twisted together. One of the wires is for the forward signal, and the other wire is for the return signal. Although twisted pair cables have certain advantageous properties, they are not immune to noise problems. Noise from external sources causes signals to be introduced into both of the wires. By twisting the wires, the noise produces a common mode signal, which can at least partially be removed at the receiver by using a difference signal.

However, such twisting method in itself is ineffective when the noise source is too close to the twisted pair cable. When the noise source is close to the cable, it couples with the two wires more effectively, and the receiver is unable to efficiently eliminate the common mode signal. Moreover, one of the wires in the pair can cause cross talk with another wire of the pair, which is additive along the length of the twisted pair cable.

Accordingly, a need remains for noise dampening coaxial and twisted pair cables capable of reducing unwanted electromagnetic interference from impacting the transmission of signals. In addition, a need remains for improving the power and energy efficiencies of coaxial and twisted pair cables. Embodiments of the invention address these and other limitations in the prior art.

The foregoing and other features of the invention will become more readily apparent from the following detailed description, which proceeds with reference to the accompanying drawings.

DETAILED DESCRIPTION

Embodiments of the invention include energy efficient noise dampening coaxial and twisted pair cables, associated materials and components, and methods for making the same. The terms "electromagnetic noise" or "interference" as used herein generally refer to unwanted electromagnetic waves or signals having the potential to disrupt the operation of electronic equipment or other devices, or other signals being transmitted over the cables. It should be understood, however, that the coaxial cable and twisted pair cable embodiments disclosed herein can provide beneficial electromagnetic wave dampening for any type of electromagnetic signal, whether or not it is considered "noise" per se, and whether or not actual disruption is caused, and therefore, such terms should be construed broadly. In addition, the figures are not necessarily drawn to scale.

Figure 1A:
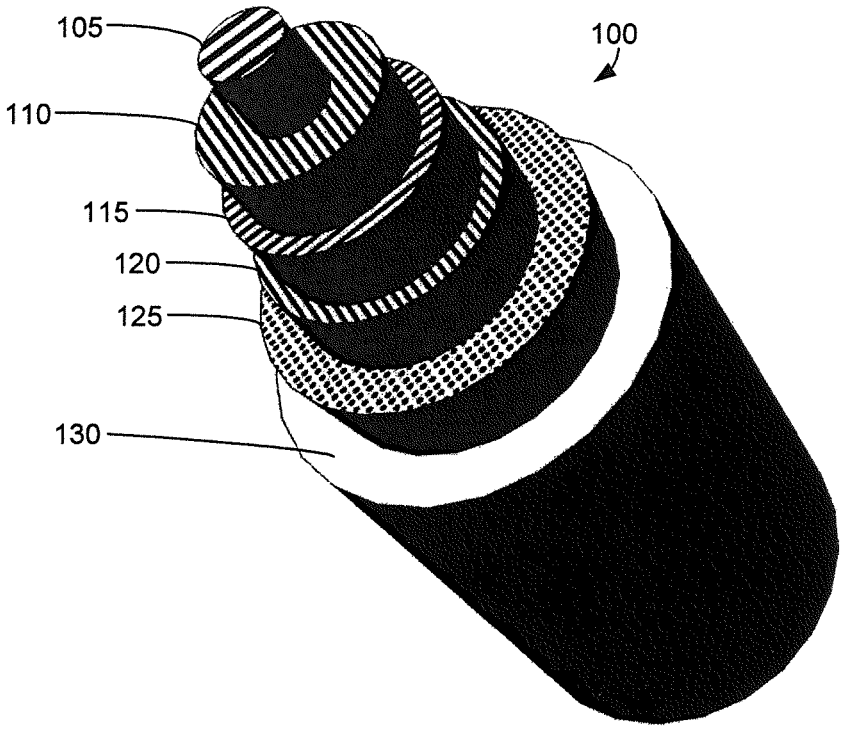
FIG. 1A illustrates a perspective view of an energy efficient noise dampening coaxial cable according to an example embodiment of the present invention.
Figure 1B:
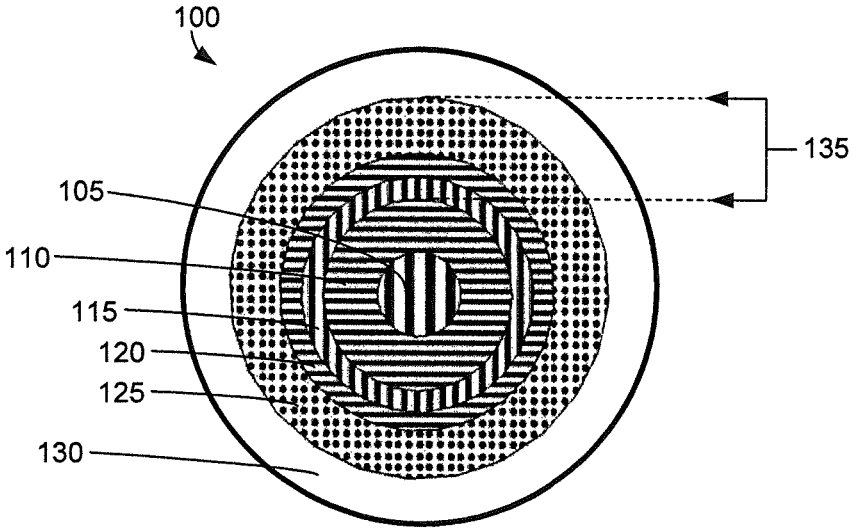
FIG. 1B illustrates a cross sectional view of the energy efficient noise dampening coaxial cable of FIG. 1A.

FIG. 1A illustrates a perspective view of an energy efficient noise dampening coaxial cable 100 according to an example embodiment of the present invention. FIG. 1B illustrates a cross sectional view of the energy efficient noise dampening coaxial cable 100 of FIG. 1A. Reference is now made to FIGS. 1A and 1B.

The noise dampening coaxial cable 100 includes a conductive core 105, a first insulating layer 110 surrounding the conductive core 105, a metal shield layer 115 surrounding the first insulating layer 110, a second insulating layer 120 surrounding the metal shield layer 115, a carbon material layer 125 surrounding the second insulating layer 120, and a protective sheath 130 wrapping the carbon material layer 125.

The metal shield layer 115 can be a flexible conducting metal layer, including for example, copper (Cu), but can include any suitable conductor including gold (Au), silver (Ag), and so forth. Moreover, the metal shield layer 115 can be a substantially solid foil, conductive paint, or the like; alternatively, the metal shield layer 115 can include a mesh of conductive wires, or any combination of foil and mesh. The conductive core 105 can be any suitable conductor such as a copper wire, or other metal or non-metal conductor. The insulating layers 110 and 120 can include glass fiber material, plastics such as polyethene, or any other suitable dielectric insulating material. Preferably, the thickness of the second insulating layer 120 is less than the thickness of the first insulating layer 110. In addition, the protective sheath 130 can include a protective plastic coating or other suitable protective material, and is preferably a non-conductive insulating sleeve.

The carbon material layer 125 is preferably up to one (1) millimeter in thickness, although thicker layers can be used. In some embodiments, the carbon material layer 125 can include strands of carbon fiber, and/or resin-impregnated woven carbon fiber fabric, among other configurations as explained in detail below.

The metal shield layer 115, the insulating layer 120, and the carbon material layer 125 form an electromagnetic dampening zone 135 surrounding the conductive core 105 in which the carbon material layer 125 enhances the shielding characteristics of the metal shield layer 115.

The positioning of the carbon material layer 125 with respect to the metal shield layer 115, separated by the insulating layer 120, enhances the metal shield layer operation of dampening electromagnetic noise. Specifically, unwanted electromagnetic interference is prevented from impacting signal quality. In other words, the dampening zone 135 diminishes the degrading effects of unwanted electromagnetic radiation that would otherwise interfere with signals being transmitted through the cable 100. The result is less noise introduced into the signal that is transmitted or received over the cable 100, thereby enhancing the quality and integrity of the signal.

The first insulating layer 110 can directly contact the conductive core 105. Similarly, the metal shield layer 115 can directly contact the first insulating layer 110. In addition, the second insulating layer 120 can directly contact the metal shield layer 115, and the carbon material layer 125 can directly contact the second insulating layer 120. In some embodiments, the protective sheath 130 directly contacts the carbon material layer 125. It should be understood that while the perspective view of the cable 100 in FIG. 1A shows different layers protruding at different lengths, this is primarily for illustrative purposes, and the layers of the cable are generally flush so that the cable 100 is formed in a substantially cylindrical or tubular embodiment.

In some embodiments, the location of the carbon material layer 125 is swapped with the location of the metal shield layer 115 (not shown). In other words, the ordering of the layers can be such that the carbon material layer 125 directly contacts the first insulating layer 110, and the metal shield layer 115 directly contacts the protective shield 130 and the second insulating layer 120. In this configuration, electromagnetic signals produced by the cable are contained within the cable and are prevented from interfering with external electronic devices. It should be understood that multiple layers of metal shields and/or multiple layers of carbon material can be used so that electromagnetic interference is prevented from penetrating the cable 100, and also prevented from escaping the cable 100.

Figure 2A:
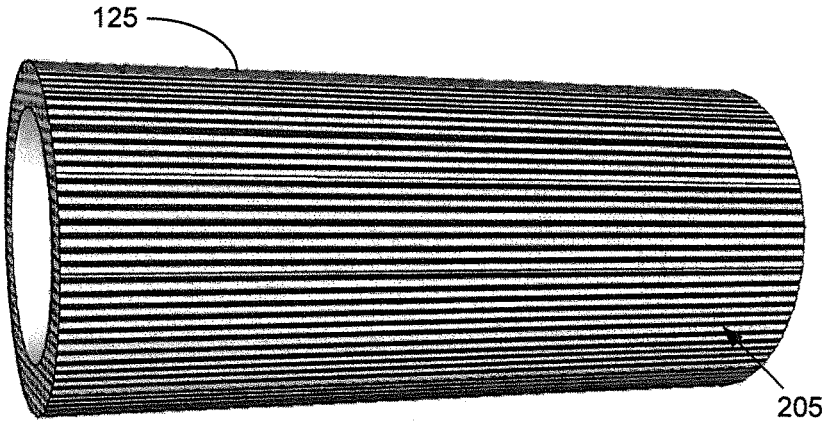
FIG. 2A illustrates a perspective view of a carbon material layer, which can be disposed within the energy efficient noise dampening coaxial cable of FIG. 1A.
Figure 2B:
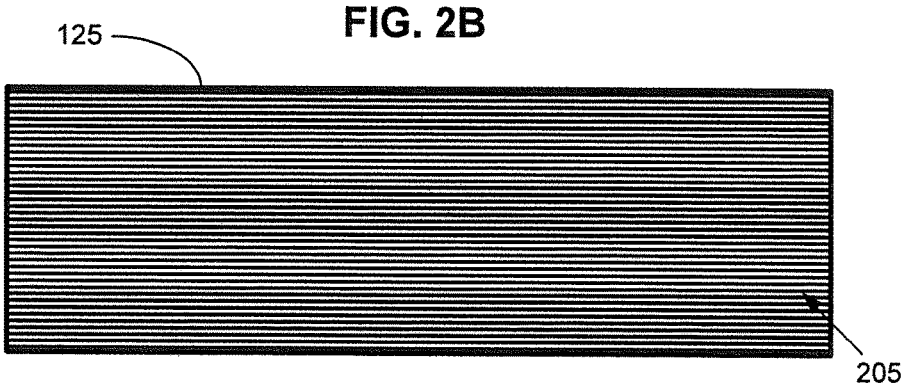
FIG. 2B illustrates a side elevation view of the carbon material layer of FIG. 1A according to one example embodiment.
Figure 2C:
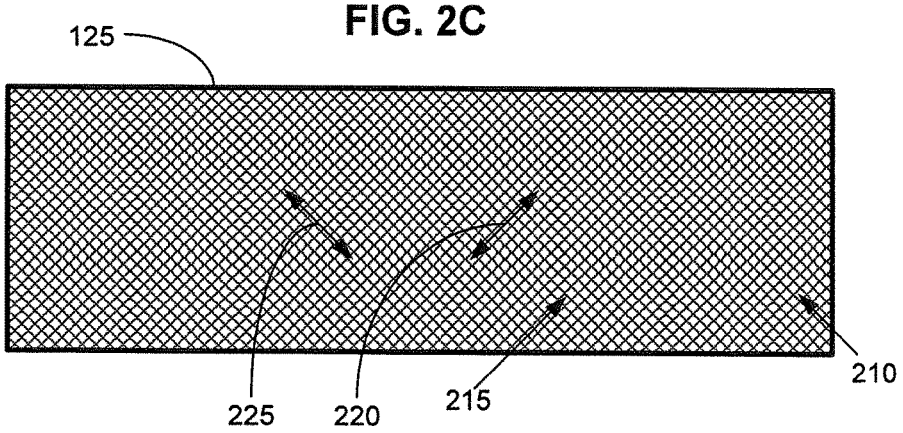
FIG. 2C illustrates a side elevation view of the carbon material layer of FIG. 1A according to another example embodiment.

FIG. 2A illustrates a perspective view of the carbon material layer 125, which can be disposed within the coaxial cable 100 of FIG. 1A. FIG. 2B illustrates a side elevation view of the carbon material layer 125 of FIG. 1A according to one example embodiment. FIG. 2C illustrates a side elevation view of the carbon material layer 125 of FIG. 1A according to another example embodiment. Reference is now made to FIGS. 2A, 2B, and 2C.

The carbon material layer 125 can include strands 205 of carbon fiber running along a length of the cable 100, for example, in parallel relative to an axial direction of the conductive core 105. In some embodiments, substantially all of the fiber strands of the carbon material layer 125 are disposed in parallel relative to the axial direction of the conductive core 105.

Alternatively, the strands of carbon fiber may run circumferentially (not shown) around the carbon material layer 125 relative to the core 105. In yet another configuration, the multiple layers of strands of carbon fiber can be disposed one atop another, and/or woven, with each layer having the carbon strands orientated at a different angle respective to one another. For example, one layer of carbon fiber strands 210 can be orientated in one direction 220, and another layer of carbon fiber strands 215 can be orientated in another direction 225 at 90 degrees relative to the layer of strands 210, as shown in FIG. 2C.

Moreover, the layers of carbon fiber strands can be orientated relative to the axial direction of the conductive core 105 at an angle other than 90 degrees. For instance, the carbon material layer 125 can include a first layer having fiber strands orientated in a first direction at substantially 45 degrees relative to an axial direction of the conductive core 105, and a second layer having fiber strands orientated in a second direction crossing the fiber strands of the first layer at substantially 45 degrees relative to the axial direction of the conductive core 105. In other words, the first and second layers can be orientated relative to each other at 90 degrees, and at the same time, orientated relative to the axial direction of the conductive core 105 at 45 degrees, as illustrated in FIG. 2C.

In this manner, electrons can travel along certain paths or patterns in the carbon material layer, allowing the electromagnetic noise characteristics of the environment to be controlled. It should be understood that a weave pattern can be used, and can include other forms or patterns depending on the qualities and noise characteristics of a particular cable 100 or the surrounding environment.

In some embodiments, the carbon material layer 125 can be resin-impregnated, and/or include a resin-impregnated woven carbon fiber fabric. In a preferred embodiment, the resin-impregnated carbon material has a specific resistance no greater than 100 $\Omega/cm^2$. In some embodiments, the carbon material layer 110 includes carbon nanotube material.

Figure 3:
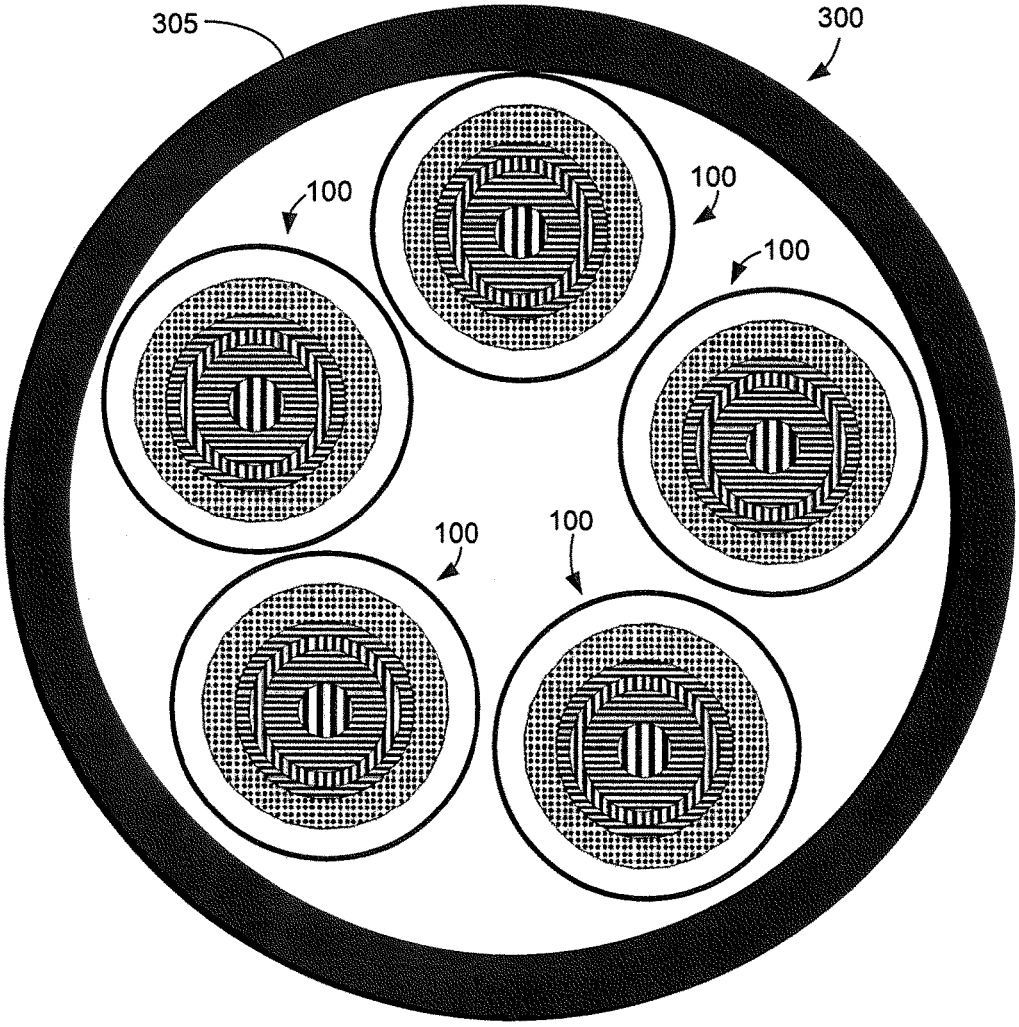
FIG. 3 illustrates a complex coaxial cable according to some example embodiments of the present invention.

FIG. 3 illustrates a complex coaxial cable 300 according to some example embodiments of the present invention. The complex coaxial cable 300 can include an outer protective sheath 305, and a plurality of inner coaxial cables 100. Each of the inner coaxial cables 100 can correspond with the coaxial cable embodiments described above. In some embodiments, each of the inner coaxial cables 100 includes a conductive core 105, a first insulating layer 110 surrounding the conductive core 105, a metal shield layer 115 surrounding the first insulating layer 110, a second insulating layer 120 surrounding the metal shield layer 115, a carbon material layer 125 surrounding the second insulating layer 120, and an inner protective sheath 130 wrapping the carbon material layer 125.

In each of the inner coaxial cables 100, the thickness of the second insulating layer 120 is preferably less than the thickness of the first insulating layer 110. The characteristics of the carbon material layer 125, the metal shield layer 115, and the insulating layers 110 and 120 are the same as or similar to those characteristics described above. For the sake of brevity, a detailed description of such characteristics is not repeated.

Figure 4A:
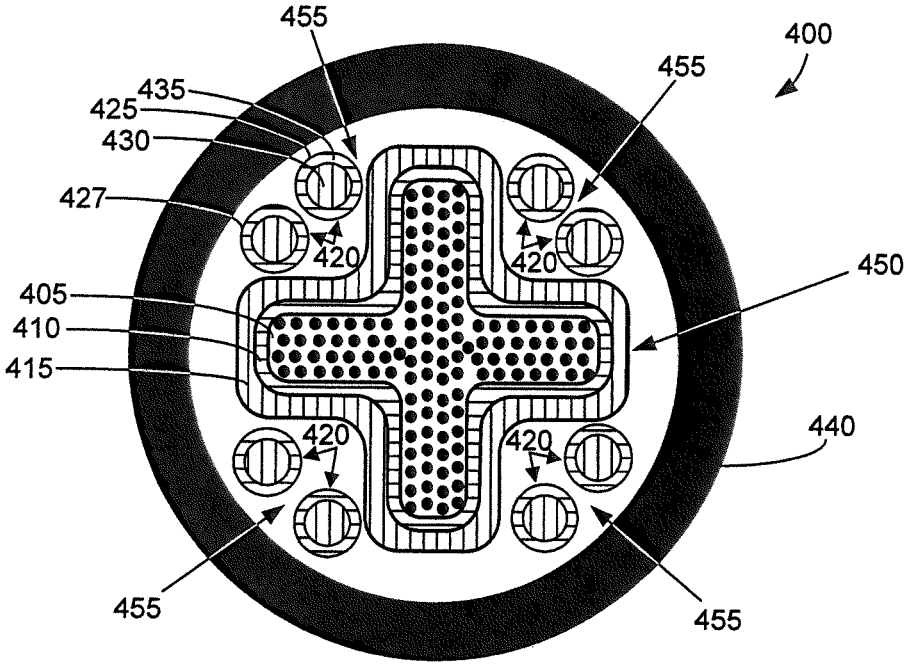
FIG. 4A illustrates a cross sectional view of a noise dampening twisted pair cable according to an example embodiment of the present invention.

FIG. 4A illustrates a cross sectional view of a noise dampening twisted pair cable 400 according to an example embodiment of the present invention. The twisted pair cable can include a core section 450. The core section can include a carbon material core 405, an insulating layer 410 surrounding the carbon material core 405, and a metal shield layer 415 surrounding the insulating layer 410. A protective sheath 440 wraps the core section 450. A plurality of twisted pair cables 420 are disposed between the core section 450 and the protective sheath 440.

A plurality of sections 455, or in other words, length-wise compartments 455, are defined by the shape of the core section 450. The sections or compartments 455 run parallel to an axial direction of the core section 450. Although four compartments are shown, it should be understood that the 'X' cross section of the core section 450 can be in the shape of a cross. However, the cross section need not be in the shape of a cross.

For instance, the cross section of the core section 450 can instead be in the shape of a star, thereby defining additional sections or compartments 455. Indeed, the core section 450 can define 3, 4, 5, 6, or any suitable number of sections or compartments 455. Each of the sections or compartments 455 can have disposed therein a twisted pair cable 420. For instance, five or more sections 455 can be defined by the core section 450, in which each of the twisted pair cables 420 is disposed in a corresponding one of the five or more sections 455.

Each of the twisted pair cables 420 can include a first cable member 425 and a second cable member 427. Each of the first and second cable members 425/427 includes an insulating layer 435 surrounding a conductive core 430. The conductive core 430 can be a flexible conducting metal wire, including for example, copper (Cu), but can include any suitable conductor including gold (Au), silver (Ag), and so forth. Indeed, the conductive core 105 can be any suitable conductor including metal or non-metal conductors. The insulating layer 435 can include glass fiber material, plastics such as polyethene, or any other suitable dielectric insulating material.

The core section 450 forms an electromagnetic dampening zone between the twisted pair cables 420, thereby reducing electromagnetic interference between the twisted pair cables 420. Specifically, unwanted electromagnetic interference is prevented from impacting signal quality. In other words, the dampening zone includes the carbon material core 405, the insulating layer 410, and the metal shield layer 415, which diminishes the degrading effects of unwanted electromagnetic radiation that would otherwise interfere with signals being transmitted through the individual twisted pair cables 420. Cross talk is reduced or eliminated between individual twisted pair cables 420 because the core section 450 blocks the interference. The result is less noise introduced into the signals that are transmitted or received over the cable 400, thereby enhancing the quality and integrity of the signals.

Figure 4B:
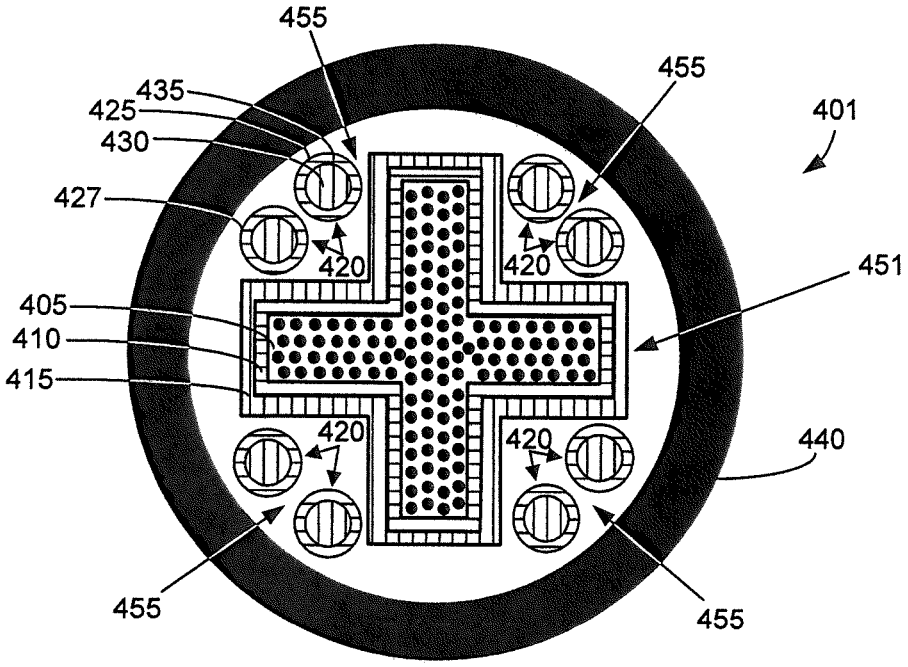
FIG. 4B illustrates a cross sectional view of a noise dampening twisted pair cable according to another example embodiment of the present invention.

FIG. 4B illustrates a cross sectional view of a noise dampening twisted pair cable 401 according to another example embodiment of the present invention. The components of the twisted pair cable 401 are the same as or similar to those described above with reference to FIG. 4A. The shape of the core section 451 shown in FIG. 4B corresponds more closely to a cross or 'X' shape without the curvy walls as exist with the core section 450 of FIG. 4A. Otherwise, the components and operation of each of the elements of the cable 401 closely correspond to those described above.

Figure 5:
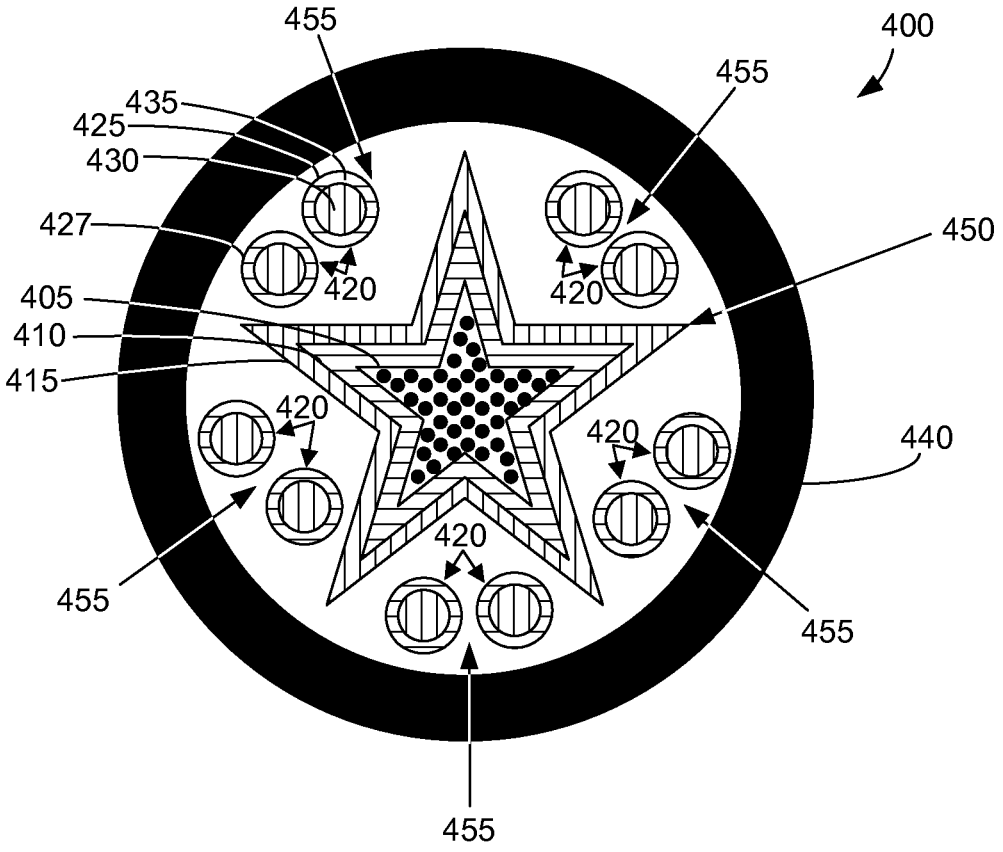
FIG. 5 illustrates a cross sectional view of a noise dampening twisted pair cable according to another example embodiment of the present invention.

FIG. 5 illustrates a cross sectional view of a noise dampening twisted pair cable 400 according to an example embodiment of the present invention. The twisted pair cable can include a core section 450. The core section can include a carbon material core 405, an insulating layer 410 surrounding the carbon material core 405, and a metal shield layer 415 surrounding the insulating layer 410. A protective sheath 440 wraps the core section 450. A plurality of twisted pair cables 420 are disposed between the core section 450 and the protective sheath 440.

A plurality of sections 455, or in other words, length-wise compartments 455, are defined by the shape of the core section 450. The sections or compartments 455 run parallel to an axial direction of the core section 450. Although five compartments are shown, it should be understood that the 'X' cross section of the core section 450 can be in a shape of a star. However, the cross section need not be in the shape of a star.

Each of the twisted pair cables 420 can include a first cable member 425 and a second cable member 427. Each of the first and second cable members 425/427 includes an insulating layer 435 surrounding a conductive core 430. The conductive core 430 can be a flexible conducting metal wire, including for example, copper (Cu), but can include any suitable conductor including gold (Au), silver (Ag), and so forth. Indeed, the conductive core 105 can be any suitable conductor including metal or non-metal conductors. The insulating layer 435 can include glass fiber material, plastics such as polyethene, or any other suitable dielectric insulating material.

The core section 450 forms an electromagnetic dampening zone between the twisted pair cables 420, thereby reducing electromagnetic interference between the twisted pair cables 420. Specifically, unwanted electromagnetic interference is prevented from impacting signal quality. In other words, the dampening zone includes the carbon material core 405, the insulating layer 410, and the metal shield layer 415, which diminishes the degrading effects of unwanted electromagnetic radiation that would otherwise interfere with signals being transmitted through the individual twisted pair cables 420. Cross talk is reduced or eliminated between individual twisted pair cables 420 because the core section 450 blocks the interference. The result is less noise introduced into the signals that are transmitted or received over the cable 400, thereby enhancing the quality and integrity of the signals.

While some examples of noise dampening and energy efficient cable types and configurations are disclosed herein, persons with skill in the art will recognize that the inventive concepts disclosed herein can be implemented with a variety of different cable types, shapes, and forms. The thickness of each of the various layers including the carbon material layer, the metal shield layers, and/or the insulating dielectric layers, can be, for example, up to one (1) millimeter in thickness, although in practice, some layers are designed to be thicker than other layers, as set forth in detail above. The thickness of the layers can be increased for higher frequency needs, and decreased for lower frequency needs. In other words, cables in which high frequency signals are transmitted include a thicker carbon fiber material layer, metal shield layer, and/or insulating layers than would otherwise be used with cables in which low frequency signals are transmitted.

Methods for constructing the coaxial and twisted pair cables are also herein disclosed. For example, a method for constructing the coaxial cable 100 can include disposing a first insulating layer 110 around the conductive core 105, disposing a metal shield layer 115 around the first insulating layer 110, disposing a second insulating layer 120 around the metal shield layer 115, disposing a carbon material layer 125 around the second insulating layer 120, and disposing a protective sheath 130 wrapping the carbon material layer 125. Similarly, a method for constructing a complex coaxial cable 300 includes disposing multiple coaxial cables 100, as described above, within an outer protective sheath 305.

A method for constructing the twisted pair cables 400 and/or 401 can include forming a core section 450. Forming the core section 450 can include disposing an insulating layer 410 around the carbon material core 405, and disposing a metal shield layer 415 around the insulating layer 410. The method can further include disposing a plurality of twisted pair cables 420 between the core section 450 and the protective sheath 440, or in other words, within sections or compartments 455 defined by the core section 450. In addition, the method can include wrapping the protective sheath 440 around the core section 450 and the twisted pair cables 420.

Power and energy efficiencies are also improved. For instance, as the noise qualities of the coaxial and twisted pair cables are improved, the signal qualities also improve, and the resulting signal transmissions can operate with lower voltages, use fewer transmitter and receiver parts, less power, and so forth. In other words, the power consumption characteristics and energy efficiencies associated with the use of the noise dampening coaxial and twisted pair cables are significantly improved, and can reduce demands on the energy infrastructure. Given that there are millions of miles of cables in existence, such power and energy improvements can quickly multiply into significant reductions in power usage, thereby boosting conservations efforts worldwide.

Consequently, in view of the wide variety of permutations to the embodiments described herein, this detailed description and accompanying material is intended to be illustrative only, and should not be taken as limiting the scope of the invention.

The invention claimed is:

1. A cable, comprising:

an electromagnetic dampening core section, the core section including:

a carbon material core formed of strands of carbon fiber;

a substantially solid and contiguous metal shield layer; and an insulating layer disposed between the carbon material core and the metal shield layer;

a protective sheath wrapping the core section; and a plurality of twisted pair cables disposed between the core section and the protective sheath, wherein a cross section of the core section and the carbon material core is in a shape of a cross with substantially rectangular protrusions forming at least four different sections with each of the twisted pair cables disposed in a corresponding one of the at least four sections.

2. The cable of claim 1, wherein each of the twisted pair cables includes a first cable member and a second cable member.

3. The cable of claim 2, wherein each of the first and second cable members includes an insulating layer surrounding a conductive core.

4. The cable of claim 1, wherein the electromagnetic dampening core section forms an electromagnetic dampening zone between the twisted pair cables, thereby reducing electromagnetic interference between the twisted pair cables.

5. The cable of claim 1, wherein the thickness of the substantially solid and contiguous metal layer is up to 1 millimeters in thickness.

* * * * *